US007954671B2

(12) United States Patent
Terrasi

(10) Patent No.: US 7,954,671 B2
(45) Date of Patent: Jun. 7, 2011

(54) PACK, ESPECIALLY FOR BREATH FRESHENING PRODUCTS

(75) Inventor: Giuseppe Terrasi, Benevello (IT)

(73) Assignee: Soremartec, Schoppach-Arlon (BE)

( * ) Notice: Subject to any disclaimer, the term of this patent is extended or adjusted under 35 U.S.C. 154(b) by 1126 days.

(21) Appl. No.: 11/439,446

(22) Filed: May 24, 2006

(65) Prior Publication Data

US 2007/0186924 A1 Aug. 16, 2007

(30) Foreign Application Priority Data

Feb. 15, 2006 (IT) ..... TO2006A0109

(51) Int. Cl.
*B67D 7/74* (2010.01)

(52) U.S. Cl. ..... 222/129; 222/192; 222/402.13; 221/96

(58) Field of Classification Search ..... 222/129, 222/402.13, 182, 135, 556, 192; 206/226, 206/229; 128/200.23; 220/254, 307, 339; 401/139; 431/253; 221/96
See application file for complete search history.

(56) References Cited

U.S. PATENT DOCUMENTS

| | | | | |
|---|---|---|---|---|
| 3,093,239 | A * | 6/1963 | Hart | 206/540 |
| 4,515,556 | A * | 5/1985 | Vanelli | 431/253 |
| 4,516,676 | A * | 5/1985 | Cournoyer | 206/226 |
| 4,538,731 | A * | 9/1985 | Cillario | 206/540 |
| 4,932,563 | A * | 6/1990 | Diamond et al. | 222/129 |
| 5,636,732 | A * | 6/1997 | Gilels et al. | 206/37 |
| 5,819,944 | A * | 10/1998 | Terrasi | 206/534 |
| 6,010,034 | A * | 1/2000 | Walthers | 222/135 |
| 6,079,586 | A * | 6/2000 | Hanneman | 220/526 |
| 6,394,987 | B1 * | 5/2002 | Sandlin et al. | 604/289 |
| 6,923,166 | B2 * | 8/2005 | Barnes et al. | 123/559.1 |
| D573,878 | S * | 7/2008 | Rathbone et al. | D9/420 |
| 2004/0188284 | A1 * | 9/2004 | Shurman | 206/242 |
| 2006/0011660 | A1 * | 1/2006 | Sandlin | 222/321.9 |

FOREIGN PATENT DOCUMENTS

GB 2412835 A * 10/2005

* cited by examiner

*Primary Examiner* — Kenneth Bomberg
*Assistant Examiner* — Daniel R Shearer
(74) *Attorney, Agent, or Firm* — Rothwell, Figg, Ernst & Manbeck, P.C.

(57) ABSTRACT

The pack comprises a container defining a containment volume containing pastilles or the like, a lid closing off the said containment volume and includes a flap for dispensing the pastilles or the like. The pack also contains a spray dispenser including a sprayable fluid and spray nozzle for dispensing the fluid. The spray dispenser is inserted within the containment volume of the container with the spray nozzle associated with the lid.

8 Claims, 4 Drawing Sheets

PACK, ESPECIALLY FOR BREATH FRESHENING PRODUCTS

This invention relates to a pack comprising a container of the type currently used for the packaging and retail sale of granular or particulate products, such as in particular pastilles and the like.

The purpose of the invention is to provide a pack which comprises and permits the delivery of a first particulate product together with a second product in the fluid state, in which the said first and second products are suitable for combined and/or sequential use.

In particular, one object of the invention is a pack comprising:

a container defining a containment volume including pastilles and the like, a lid closing the said containment volume, and means for delivery of the said pastilles, characterised in that it comprises a spray dispenser comprising a containment body including a sprayable or atomisable fluid and pressure operating means for delivery of the fluid, the said spray dispenser being inserted within the containment volume of the container, with the said pressure operating means associated with the lid.

Containers of the type specified above are generally constructed in the form of boxes of small size, for example of prismatic shape, of moulded plastics material (using thermoforming, injection, etc., processes), optionally transparent or translucent, or of laminar material such as board, also optionally provided with windows so as to make the products within the container visible.

The first particulate product, also defined here as "pastilles or the like", is intended to include all products taking the form of pastilles, pellets, comfits, dragées, tablets, pills, lozenges, capsules, etc., of small size, so that they can be taken and consumed orally with ease. Use of comfits or pastilles having a shell or outer part obtained by coating is preferred.

These may for example relate to food products or sweetmeats and preferably relate to breath freshening products, but also products intended for various uses, such as for example pharmaceutical products.

The fluid product present in the spray dispenser is preferably a liquid composition, designed to be administered to the user' mouth as a spray, for example, a breath-freshening composition, but also a disinfectant composition, mouthwash or the like.

In the preferred embodiment the pastille or similar product is a breath-freshening sweetmeat product and, in combination, the fluid product is also a composition for refreshing the breath and the throat.

Figure 2:
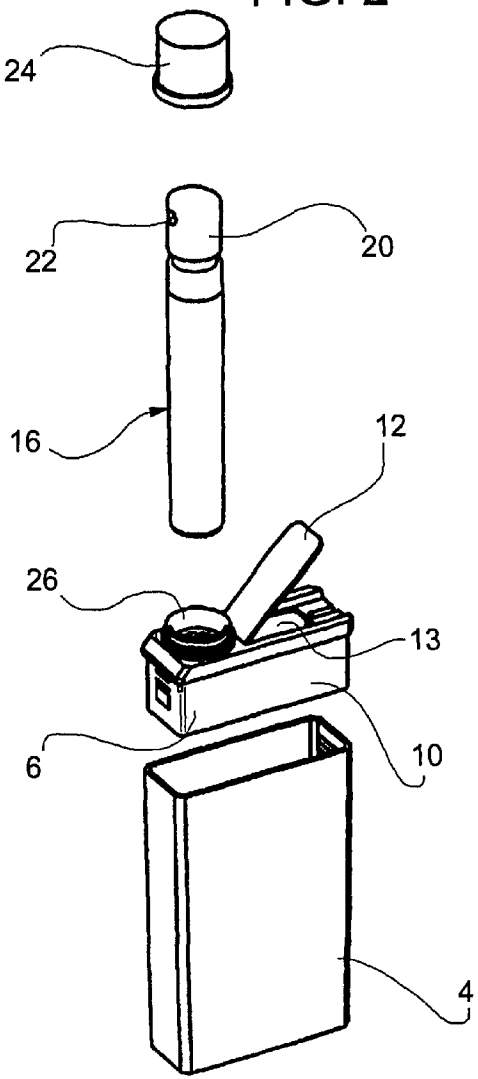
Figure 1:
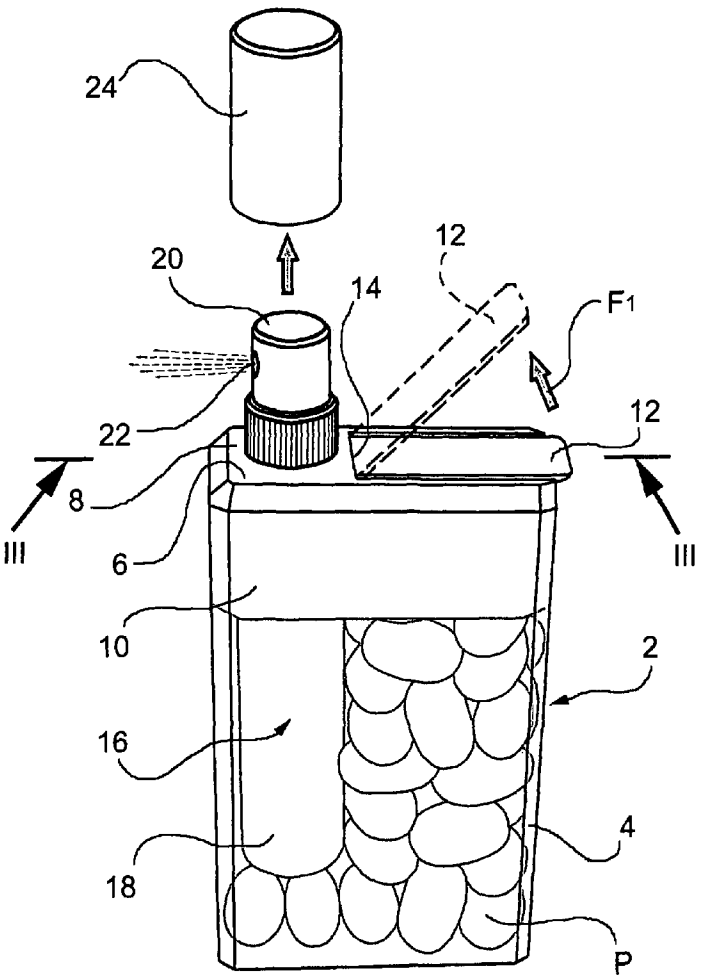
Figure 4:
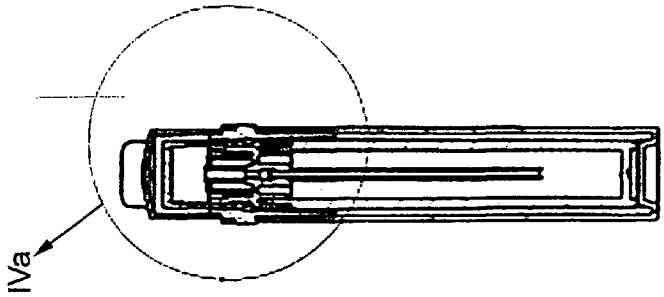
Figure 3A:
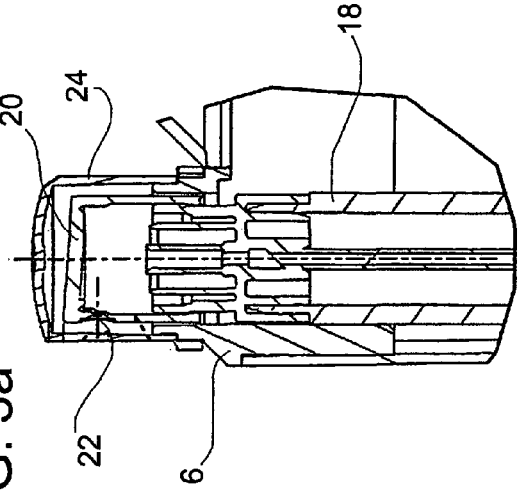
Figure 4A:
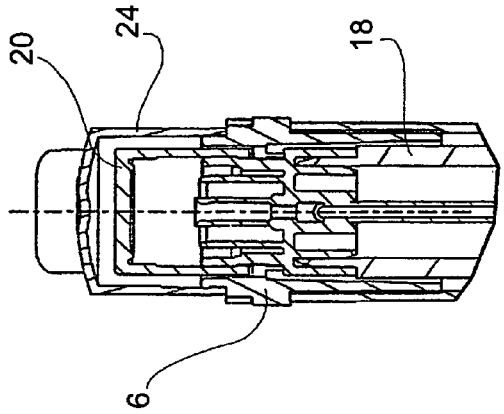
Figure 3:
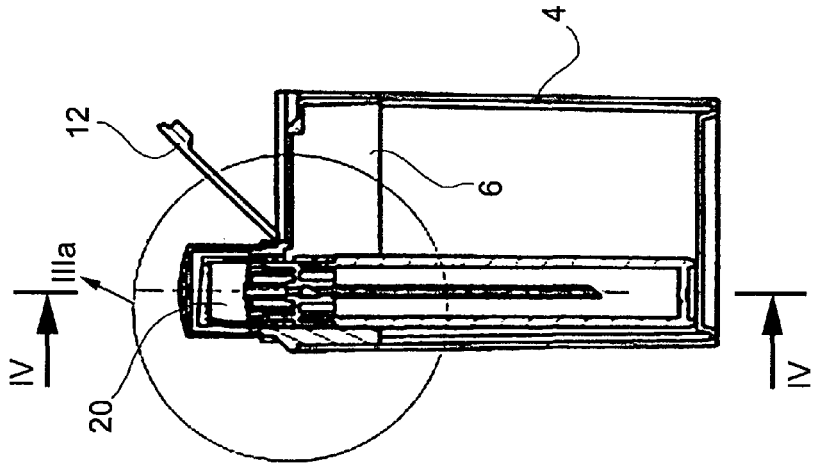
Figure 5:
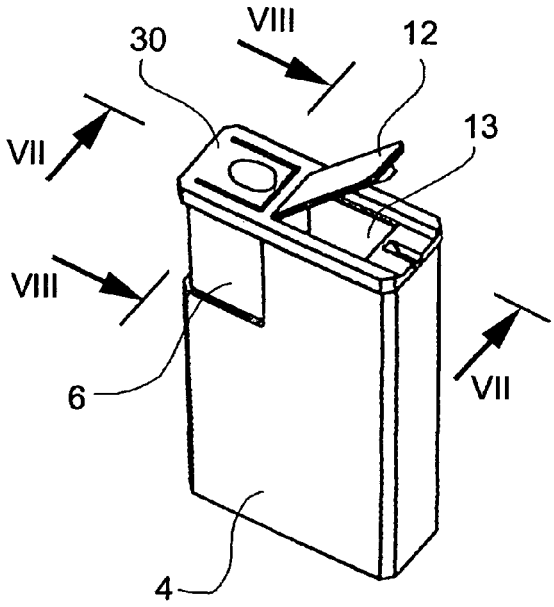
Figure 6:
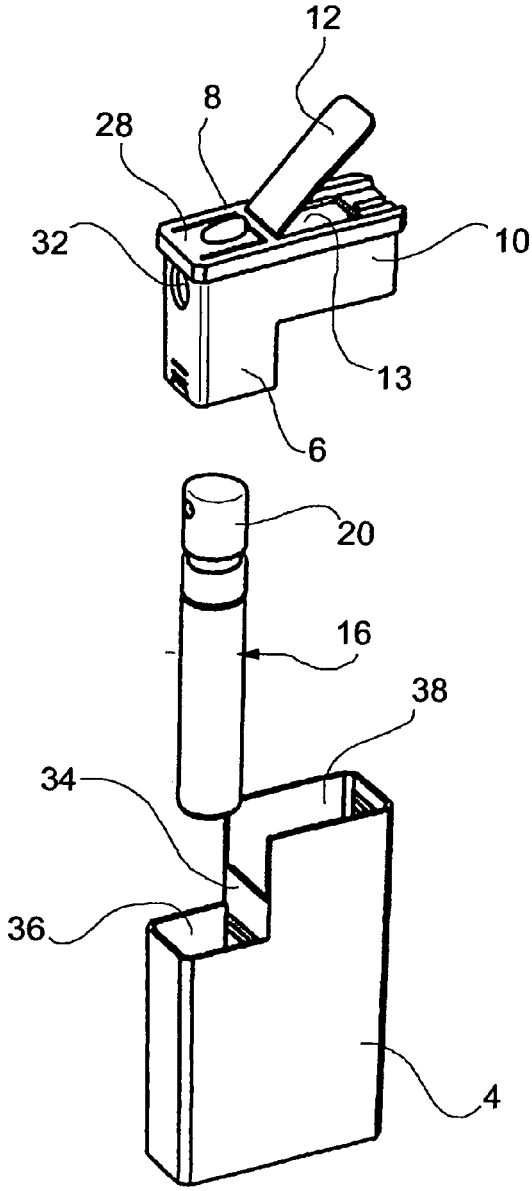
Figure 8:
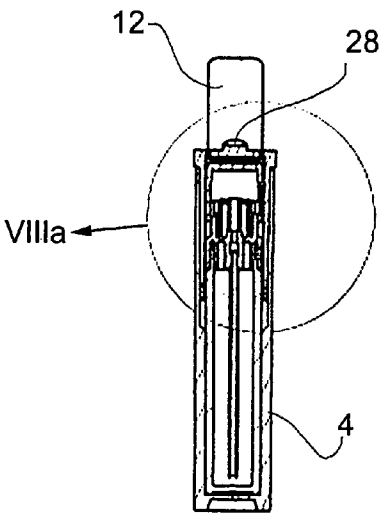
Figure 7A:
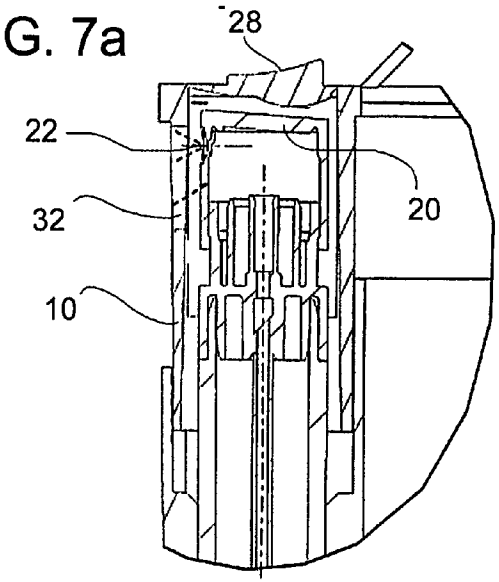
Figure 8A:
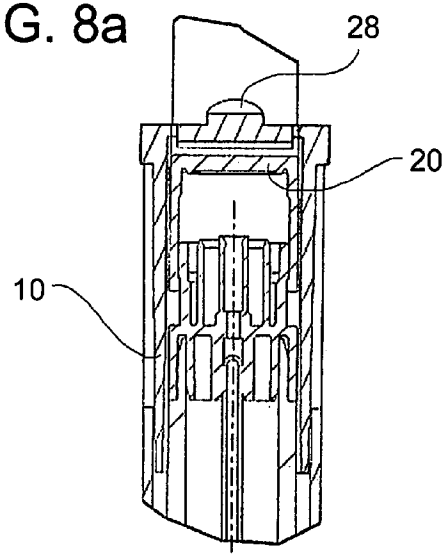
Figure 7:
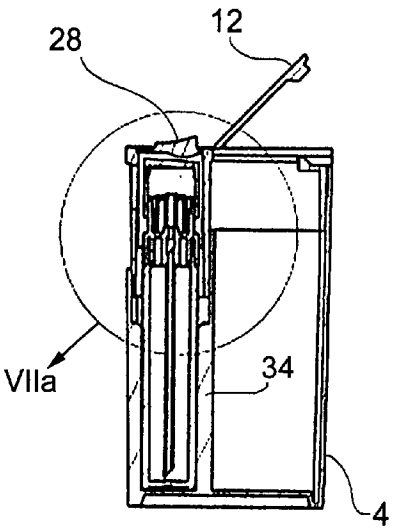

Other advantages and characteristics of the present invention will become clear from the following detailed description which is given with reference to the appended drawings which are provided purely by way of non-limiting example and in which:

FIG. 1 is a perspective partly exploded view of a pack according to the invention, FIG. 2 is a perspective exploded view of the pack in FIG. 1, FIG. 3 is a view in cross-section along the line III-III in FIG. 1, FIG. 3A is a view in cross-section of a magnified detail of FIG. 3, FIG. 4 is a view in cross-section along the line IV-IV in FIG. 1, FIG. 4A is a view in cross-section of a magnified detail of FIG. 4, FIG. 5 is a perspective view of a pack according to the invention, according to another embodiment, FIG. 6 is a perspective exploded view of the pack in FIG. 5, FIG. 7 is a view in cross-section along the line VII-VII in FIG. 5, FIG. 7A is a view in cross-section of a magnified detail of FIG. 7, FIG. 8 is a view in cross-section along the line VIII-VIII in FIG. 5, and FIG. 8A is a view in cross-section of a magnified detail in FIG. 8.

The drawings illustrate a pack according to the invention comprising a container for products, such as pastilles and the like, indicated as a whole by 2 which in the embodiments illustrated takes the form of a box with a prismatic containment body 4 of elongated flattened shape defining within it a containment volume for granular products P, such as pastilles and the like.

Typically the body of the container is manufactured from a transparent plastics material so that products P lying within may be seen.

The prismatic body 4 is closed off at its opening by a lid 6, which is also made for example of plastics material. The lid 6 is similar to a type of hollow cap, of prismatic shape, which completely closes off the mouth part of the body 4 with an upper wall 8 and a side wall in the form of a skirt 10 inserted so as to engage within the mouth of body 4. Typically the lid is also manufactured from plastics material, which is generally non-transparent.

The upper wall 8 of the lid is associated with a flap 12 which is hinged at 14 and is capable of being orientated in an open position as indicated by the arrow F1 in FIG. 1 to disclose an opening 13 through which products P can be delivered from the container. The flap 12 is capable of snap engagement in the closed position with the upper wall 8 defining the lid.

The embodiment in FIG. 1 specifically relates to a container of the type currently used for breath-freshening dragées marketed under the trade name TIC TAC®. It is intended however that the prismatic shape described is not of course to be understood to be restrictive, although a container of elongated shape is generally preferable.

In accordance with the invention the pack comprises a spray dispenser 16 associated with container 2. The term spray dispenser is intended to mean any dispenser suitable for dispensing a fluid, in particular a liquid, in spray, atomised or aerosol form, through a dispensing nozzle.

In one embodiment the spray dispenser may comprise a pump dispenser, for example of the type currently used for the spray dispensing of perfume samples, with a tubular containment body 18 and a pressurised operating plunger 20 having a spray dispensing nozzle 22.

Alternatively the dispenser may comprise a pressurised container, for example in the form of a small cylinder, containing the liquid which has to be dispensed in combination with a volatile liquid for food use, a propellant agent and a dispensing plunger 20.

In the appended drawings the spray dispenser 16 comprises a pump dispenser of the type which is in itself known. In the embodiment in FIGS. 1-4 the means for operating the spray dispenser comprise a pressurised operating plunger 20 connected to the containment body 18 of the dispenser in a slidable manner—in an opening 26 in the upper wall 8 of lid 6, with the nozzle 22 projecting externally from the lid; the liquid is dispensed by exerting a pumping pressure, which may be repeated, on the plunger 20.

The structure of the dispenser can be seen in detail in cross-section in FIGS. 3A and 4A, and as it is in itself known does not require any further description here. The dispensing nozzle is preferably protected by means of a cap 24.

In the embodiment of FIGS. 5-8, the spray dispenser 16 is wholly inserted within containment body 4 of the container and within the hollow lid 6. The operating means comprise an auxiliary pressure member 28 associated with the upper wall 8 of lid 6 and the operating plunger of the dispenser 20 on which the pressure member 28 acts.

In particular the pressure member 28 takes the form of a tongue, defined by a U-shaped notch in the upper wall 8 of lid 6, and is hinged to that wall at 30, in such a way that a pressure exerted on this tongue causes it to move angularly towards the interior of the lid 6 in such a way as thus to exert a pumping pressure on plunger 20 located in a position immediately beneath the pressure member.

The side wall 10 of the lid 6 has an opening 32 in a position opposite the nozzle 22 of the plunger 20. The containment body 4 of the container has preferably a septum 34 which divides the internal volume into two compartments 36 and 38 which are designed to receive the tubular body 18 of the spray dispenser and the granular products P respectively.

It is intended that the configuration described here for the pressure member 28 comprises a currently preferred but not binding configuration.

Preferably, the dispenser 16 contains a breath-freshening liquid, particularly in combination with pastilles, comfits, capsules or the like also having a breath-freshening effect.

The pack therefore makes it possible to use two products in combination (solid product and liquid to be sprayed), achieving a potentiated effect for the consumer.

It is intended however that the liquid present in the spray dispenser may also comprise a disinfecting liquid for the throat (for example a mouthwash liquid) or for cleaning the teeth.

The packaging is therefore suitable for use not only as pack for sweetmeat products, typically with a breath-freshening function, but also as packaging for oral hygiene, for example associating chewing gum comfits or dragées, preferably xylitol containing chewing gums with a spray-dispensable liquid for cleaning the teeth and the oral cavity.

Naturally, the principle of the invention remaining the same, the forms of embodiment and details of construction may be varied widely with respect to those described and illustrated, which have been given purely by way of example, without thereby departing from the scope of the invention.

What is claimed is:

1. A pack comprising:

a container defining a containment volume, a product selected from the group consisting of pastilles, comfits, dragées, pills and lozenges located within said containment volume, a spray dispenser located within said containment volume, said spray dispensing comprising a containment body, a sprayable or atomisable fluid located within said containment body and a movable operating plunger with a dispensing nozzle for dispensing the fluid, the operating plunger being movably connected to the containment body, a lid closing off the containment volume, said lid comprising an opening for dispensing said pastilles and an auxiliary pressure member that is movable to exert a pumping pressure to dispense the fluid by moving the operating plunger.

2. A pack according to claim 1, wherein the said auxiliary pressure member comprises a body hinged to the upper wall of the lid and the spray dispenser is inserted in the containment volume with the operating plunger in a position beneath the auxiliary pressure member in such a way that a pressure exerted on the said auxiliary pressure member causes the said auxiliary pressure member to exert a pumping pressure on the operating plunger.

3. A pack according to claim 2, wherein a side wall of the lid has an opening in a position facing said dispensing nozzle of the spray dispenser.

4. A pack according to claim 1, wherein the lid is in the form of a hollow cap inserted into a mouth of the container and a flap hinged to an upper wall of the lid selectively closes the opening.

5. A pack according to claim 1, wherein the spray dispenser comprises a pressurised container including a liquid which is to be dispensed in combination with a volatile liquid, a propellant agent, preferably for food use.

6. A pack according to claim 1, wherein the spray dispenser comprises a pump dispenser.

7. A pack according to claim 1, wherein said product is breath-freshening pastilles and said fluid is a breath-freshening liquid.

8. A pack according to claim 1, wherein said product is comfits for oral hygiene and said fluid is a liquid which can be dispensed as a spray for oral and tooth hygiene.

* * * * *